United States Patent [19]

Rende et al.

[11] 4,255,233

[45] Mar. 10, 1981

[54] USE OF POLYACRYLIC ACID IN PULP BLEACHING PROCESSES TO PRESERVE PULP STRENGTH AND AID IN BRIGHTNESS

[75] Inventors: Dominic S. Rende, Woodridge; David R. Cosper, Downers Grove, both of Ill.

[73] Assignee: Nalco Chemical Company, Oak Brook, Ill.

[21] Appl. No.: 86,239

[22] Filed: Oct. 18, 1979

[51] Int. Cl.[3] ..... D21C 9/12

[52] U.S. Cl. ..... 162/73; 162/76; 162/87

[58] Field of Search ..... 162/76, 87, 73

[56] References Cited

U.S. PATENT DOCUMENTS

| | | | |
|---|---|---|---|
| 3,539,445 | 11/1970 | Crossland | 162/87 |
| 3,878,037 | 4/1975 | Honsen et al. | 162/76 |
| 4,096,029 | 6/1978 | Mills | 162/87 |

*Primary Examiner*—William F. Smith

*Attorney, Agent, or Firm*—John G. Premo; Robert A. Miller

[57] ABSTRACT

Improved pulp strength and brightness of chemically produced pulp can be obtained by treating the pulp with the addition of 0.05—0.5% based on the weight of the dry fiber of polyacrylic acid and/or its water-soluble salts in the chlorination bleaching stages.

4 Claims, No Drawings

USE OF POLYACRYLIC ACID IN PULP BLEACHING PROCESSES TO PRESERVE PULP STRENGTH AND AID IN BRIGHTNESS

This invention relates to a process for the delignification and bleaching of cellulosic pulp produced by a chemical pulping process. Typically, processes of this type are conducted utilizing chemicals which while increasing the brightness of the resulting pulp stock cause fiber degradation and hence, a loss of pulp strength. It has been discovered, however, that through the use of an additive comprising polyacrylic acid and/or its water-soluble salts, increased brightness can be obtained and fiber degradation limited in halogen bleaching processes.

The object of delignification and bleaching of cellulosic pulp is to produce pulp with high brightness, good brightness stability and maximum pulp strength at minimum cost and with minimum environmental pollution. Unfortunately, however, achievement of or improvement in one of the above factors is often attained only at the expense of another of the important factors.

In an effort to achieve a suitable balance between the competing factors, bleach plants have resorted to multistage processes. A typical bleach plant pulp treatment comprises: (a) chlorination (C) of the pulp under acid conditions; (b) alkaline extraction (E) of the chlorinated lignin derivative from the pulp with aqueous sodium hydroxide; (c) oxidation (i.e. bleaching) with sodium hypochlorite (H) under alkaline conditions; (d) a second sodium hydroxide extraction (E); and (e) a final bleach with chlorine dioxide (D).

Such a sequence is labeled CEHED and is commonly used for delignification and bleaching of kraft (i.e. sulfate) pulp. Similar sequences with fewer stages, such as CEH or CED are commonly used for sulfite pulp which generally contains less lignin and color bodies than does sulfate pulp. Many other such sequences have been proposed and used in the industry's continuing efforts to achieve a suitable balance of the competing factors for the various pulps, pulping processes and end-use physical property requirements.

Regardless of the sequence used, the bulk of cellulose bleaching still is performed using some combination of chlorination (C), alkaline extraction (E) and oxidation (bleaching) stages. The chlorination stage converts most of the colored lignin which remains after the initial pulping or digestion process to chlorinated lignin derivatives which are partially soluble in acidic chlorine solution and particularly soluble in alkaline extraction liquors. Such stage is also referred to as the delignification stage. Although the net effect of such stage (after alkaline extraction) is generally a darkening of the cellulosic pulp attributable to increased color development in the residual lignin material, a major amount of the lignin is removed in the chlorination-extraction sequence, facilitating efficient bleaching reactions in the later oxidation stages.

An extraction stage generally follows chlorination. Such stage serves to remove the chlorinated lignin derivatives from the cellulose substrate, thus exposing for subsequent treatment the lignin material which was unaffected by the chlorination stage by virtue of the topochemical nature of the reaction. H. W. Gierts "Developments in Bleaching Processes," TAPPI, May, 1951, Volume 34 No. 5.

Hypochlorite treatments conducted under alkaline conditions, and chlorine dioxide treatments conducted at acidic pH value are primarily characterized by destructive oxidation of residual colored lignin to colorless degradation products. Such stage is therefore, primarily a bleaching stage though some minor amount of chlorination followed by extraction of the alkaline or acidic bleaching liquors may occur simultaneously.

Of the competition between important factors, the tradeoff between brightness and pulp strength (often measured as pulp viscosity) has been of particular concern to the paper industry and has been primarily responsible for the proliferation of the various bleaching sequences. Such tradeoff apparently results from a nonselective oxidation reaction. By the term "nonselective," it is meant that the oxidation action is not limited to lignin oxidation, but instead also involves destructive oxidation of the cellulosic material, thus reducing the length of the cellulosic molecules and accordingly, reducing the strength and viscosity of the pulp. The exact extent of such cellulose oxidation depends upon reaction conditions such as temperature, pH, reaction time and chlorine concentration, and upon the nature of the pulp being treated. For example, the brightness-strength tradeoff in delignification and bleaching is less pronounced for sulfite pulp than it is for sulfate pulp since less severe treatment is required for sulfite pulp than for sulfate pulp to achieve equivalent brightness characteristics.

In either case, that is for sulfite or sulfate produced pulps, fiber degradation occurs during the delignification and bleaching steps. While physical parameters such as the concentration of bleaching agent, temperature and time can be optimized for a given system, invariably pulp degradation occurs. As such, it would be a benefit to the art if a method could be obtained for maintaining pulp strength of chemically produced cellulosic pulp during the delignification and bleaching stages.

It is therefore an object of this invention to provide to the art a process for increasing brightness and limiting fiber degradation during chemical delignification and bleaching processes.

A further object of this invention is to provide to the art an improved process for the delignification and bleaching of chemically produced cellulosic pulp which encompasses maintaining in the aqueous slurry of the pulp during the initial chlorination stage from 0.05–0.5 weight percent based upon the dry weight of the fiber of polyacrylic acid and/or its water-soluble alkali metal or ammonium salts.

THE INVENTION

The present invention is applicable to all liquid phase acidic chlorination processes for the delignification of wood pulp produced by chemical pulping processes. While chlorination is the general method employed industrially for the delignification of pulps of this type, bromine or other halogens can also be employed (see for example U.S. Pat. No. 4,096,029 which is hereby incorporated by reference). It will be readily seen that this invention also applies to those processes.

The additive of this invention, polyacrylic acid or its water-soluble salts is known generally to be a dispersing agent. The exact reason or mechanism in which the polyacrylic acid of this invention functions is not known to us but results have indicated its performance in this application. The present invention is applicable to most commercial bleaching stages which use multi-stages including chlorination, extraction and generally treatment with an oxidizing agent such as chlorine dioxide. We have discovered that the chemical treatment of this invention need only be present in the initial chlorination stage and is generally added to the pulp slurry as a presoak additive immediately prior to the chlorination step. It is not known if the chemical treatment is carried forward to the other stages or where the chemical treatment of the instant invention winds up.

In the practice of this invention, the polyacrylic acid is generally added to the pulp at a dosage of from 0.5–10 pounds per ton based upon the weight of the dry pulp. Preferably, from 1–6 pounds of additive per ton dry pulp is used and most preferably from 1.5–5 pounds per ton dry pulp. This generally translates to a level of from 0.05–0.3% by weight based on the dry weight of fiber. Other additives which are generally used in the pulp bleaching process can be employed along with the materials of this invention.

A. The polyacrylic acid materials which may be employed in this invention may be polymers or copolymers containing acrylic acid or water-soluble salts of acrylic acid. While preferred materials employed in this invention are homopolymers of polyacrylic or their water-soluble alkali metal or ammonium salts, polyacrylic acid copolymers containing up to 50% by weight of nonionic monomers such as acrylamide or methacrylamide can be employed. When the term polyacrylic acid is employed in this disclosure, this term is also meant to encompass polymethacrylic acid.

While polyacrylic acid and its copolymers can be prepared directly by polymerizing acrylic acid monomers, suitable polymers useful in the practice of this invention can also be prepared by the hydrolysis of polyacrylonitrile or polyacrylamide.

The molecular weight of the polymers employed in this invention may vary greatly. Polymers employed should have minimum molecular weight of 750 and preferably 1000. Maximum molecular weights are unimportant so long as the polymer and/or its water-soluble salts remain water-soluble. Polymers having a molecular water in excess of 100,000 may be employed in this invention.

Methods for the preparation of the polymers of acrylic acid described above are well-known to those skilled in the art and need not be elaborated on here.

In order to illustrate our invention, the following examples are presented:

EXPERIMENTAL PROCEDURE

A maple-elm hardwood kraft pulp and a jack pine softwood kraft pulp were supplied by a paper company located in a northerly mid-western state. Hardwood chips had been digested to an 11.6 K number and softwood chips to a 17.0 K number. Pulp was sampled at a point beyond the screen room decker. Each pulp sample was thoroughly washed, centrifuged to approximately 35% consistency and stored at 38° F. Prior to various bleaching studies, sufficient fiber was removed from the large sample and homogenized in a static mixer to insure evenly distributed moisture. Moisture determinations were performed in triplicate by drying the pulp samples at 105° C. to a constant weight. An average value was reported to the second decimal place.

PROCEDURE FOR PULP BLEACHING

Chemical Preparation:

1. Chlorine water was prepared by dispersing chlorine gas through deionized water until saturated.

2. Caustic solutions were prepared by dissolving 25 grams of sodium hydroxide to form a 1 liter deionized water solution.

3. Hypochlorite was obtained commercially under the trademark CHLOROX and was then diluted with deionized water to approximately 10 grams (as $Cl_2$) per liter.

B. The polyacrylic acid materials utilized during pulp bleaching were used as is, percentage solids for each material are set forth in the example.

50 grams of fiber based on o.d. equivalents are placed in heat sealable polyethylene bags. Enough deionized water is then added to meet stage consistencies minus the water necessary to dissolve the bleaching chemical employed. Additives to be tested within a particular stage are added to the dilution waters of that stage. Each bag is then placed in a constant temperature bath for 30 minutes. This offers a consistent bleaching temperature and sufficient chemical to fiber contact.

Bleaching chemicals are then added to each bag and the bags are quickly heat sealed, identified and thoroughly mixed. Mixing is performed by hand massaging and continues for 2 minutes. Subsequent mixing of stage temperature stock is accomplished every 10–15 minutes. Upon stage completion, the bags are opened and enough filtrate is drawn off to conduct appropriate tests. Fiber and remaining liquors are washed out with stage temperature in deionized water to a 4:1 water to liquor ratio on a vacuum drawn Buchner funnel employing filtered paper.

The pulp mat is then separated from the filter pad and is weighed to determine moisture content for subsequent steps. Upon completion of all bleaching stages, the pulp mat is homogenized to insure evenly distributed moisture and samples are drawn for testing and to prepare 2 gram hand sheets according to TAPPI T-205. Permanganate numbers of pulps (useful to determine lignin content) were accomplished utilizing TAPPI procedure T-214. Kappa No. of pulps were determined using TAPPI T-236. Viscosity of pulp (useful to determine the amount of cellulose degradation during bleaching) was determined utilizing a capillary viscometer method as outlined in TAPPI T-230. For details of TAPPI Procedures T-230 and T-214, see U.S. Pat. No. 4,096,029.

PREPARATION OF POLYACRYLIC ACID SAMPLES

Six samples of polyacrylic acid having varying molecular weights were obtained. These samples, were neutralized to an approximate pH of 7.0 with aqueous ammonium hydroxide to produce the corresponding ammonium polyacrylate. These materials are set forth in Table I. Molecular weights are given prior to neutralization.

TABLE I

| DESIGNATION | % SOLIDS | INTRINSIC VISCOSITY | MOLECULAR WEIGHT | pH |
|---|---|---|---|---|
| A | 17.5 | .105 | 7,600 | 7.0 |
| B | 18.6 | .160 | 14,000 | 7.0 |
| C | 17.8 | .187 | 18,000 | 7.4 |
| D | 18.2 | .454 | 70,000 | 7.0 |

TABLE I-continued

| DESIGNATION | % SOLIDS | INTRINSIC VISCOSITY | MOLECULAR WEIGHT | pH |
|---|---|---|---|---|
| E | 16.6 | .559 | 96,000 | 6.6 |

EXAMPLES 1–13

The use of polyacrylic acid in the ammonium salt form was evaluated as a presoak additive during the chlorination ("C") of the hardwood pulp previously described. The accompanying Table II shows the effect of the polyacrylic acid additive during the "C" stage at varying dosages. In Example 1 an unbleached hardwood fiber, not shown in Table II, had a viscosity of 14.50 and a brightness of 28.7. A control was run with each series, and is shown as No. 2 for Examples 3–7 and as No. 8 for Examples 9–13. Viewing the results, it is seen that additives of the instant invention effectively preserved viscosity of the pulp while maintaining or increasing brightness and effective lignin removal. Molecular weight as seen, is not critical so long as the polymer is water-soluble.

TABLE II

| EXAMPLE | POLYMER SAMPLE | DOSAGE[1] | % $Cl_2$ | POST EXTRACTION VISCOSITY | POST EXTRACTION GE BRIGHTNESS | POST HYPO GE BRIGHTNESS |
|---|---|---|---|---|---|---|
| 2 | CONTROL | — | 3.15 | 12.24 | 37.7 | 68.4 |
| 3 | A | 2 | " | 14.44 | 37.9 | 69.2 |
| 4 | B | 2 | – | 14.35 | 38.1 | 68.4 |
| 5 | C | 2 | " | 14.88 | 38.6 | 68.1 |
| 6 | D | 2 | " | 14.15 | 38.4 | 69.8 |
| 7 | E | 2 | " | 14.34 | 38.4 | 69.4 |
| 8 | CONTROL | — | " | 11.89 | 37.8 | 67.0 |
| 9 | A | 4 | " | 14.39 | 38.8 | 67.7 |
| 10 | B | 4 | " | 15.17 | 38.6 | 68.3 |
| 11 | C | 4 | " | 15.24 | 38.6 | 67.5 |
| 12 | D | 4 | " | 13.83 | 38.7 | 68.1 |
| 13 | E | 4 | " | 14.37 | 38.7 | 68.2 |

[1]Pounds of aqueous ammonium polyacrylate (from Table I) per ton of oven dried fiber.

EXAMPLES

The effect of polyacrylic acid in the acid form and in the ammonium salt form were investigated in the bleaching stage upon softwood jack pine fiber. The softwood pulp employed had a permanganate number of 17.0 and a kappa number of 26.1. Unbleached fiber viscosity and brightness were 21.69±0.27 and 24.2 respectively. Chemicals were added at a rate of 3 lbs. per ton. The chlorination stage employed 4.59% chlorine, 3.0% pulp consistency for 60 minutes at room temperature. The extraction stage employed contained 2.3% sodium hydroxide, a 10% pulp consistency for 60 minutes at 160° F. The samples utilized were obtained as follows:

Sample 1 was a 50—50 by weight mixture of samples B and C prior to neutralization. Sample 2 was a 50—50 by weight mixture of these same two materials neutralized to pH 6.5 with ammonium gas. Results obtained are shown in Table III.

From the results, it is evident that both polyacrylic acid along with its water-soluble salts are effective as viscosity preservation aids in the chlorine bleaching of pulp.

Brightness of handsheets produced was measured using a General Electric reflectance meter. This instrument and its operation is well-known in the paper industry and results reported are indicated by "GE brightness." The results indicate the percentage of light reflected by a given sample.

TABLE III

| EXAMPLE | SAMPLE | POST EXTRACTION VISCOSITY AVG. | GE BRIGHTNESS AVG. |
|---|---|---|---|
| 14 | CONTROL | 16.74 ± .25 | 30.7 |
| 15 | 1 (A) | 17.69 ± .22 | 30.6 |
| 16 | 2 (B) | 19.19 ± .47 | 30.6 |

(A) Polymer Blend (Acid) 30% Active
(B) Polymer Blend pH adjusted to 6.5 with $NH_3$ gas
Polymer blends (A) and (B) were added to the chlorination stage at 3 lbs./ton of fiber in their aqueous concentrations cited above.

EXAMPLES 18–27

If the halogenation stage is viewed as the major contributor toward the structural alteration of lignin, increased delignification can be obtained by increasing one or more of the following parameters: temperature, chlorine level, pH or retention. Increasing any of the above parameters increases the hypochlorous acid concentration or activity which is believed to be the primary oxidizing agent. However, hypochlorous acid is non-specific toward lignin and has a high potential to degrade the cellulosic fibers themselves.

To utilize this potential in a positive manner, a viscosity preservation aid in the chlorination stage is required. While the prior art shows a variety of additives as potential cellulose preservation aids, the preservation of pulp cellulose through the reduction of strong chlorine radical formation can also have detrimental effects toward delignification and brightness developed. Therefore, tests were conducted utilizing 2 levels of chlorination based upon permanganate to pulp demand representing normal and excessive radical formation. In this study, unbleached softwood kraft fiber was employed having the following characteristics; permanganate number of 17.0, brightness of 24.2 and fiber viscosity of 21.90. Chlorination and extraction stage parameters are as described below:

| | | |
|---|---|---|
| Chlorination Stage: | Chlorine Levels | 3.91%, 4.76% |
| | Temperature | 75° F. |
| | Retention Period | 60 minutes |
| | Consistency | 3% |
| | Additive Levels | 3.6 pounds per ton |
| Extraction Stage: | Caustic Level | ½ chlorine demand (1.96%, 2.38%) |
| | Temperature | 160° F. |
| | Retention Period | 60 minutes |
| | Consistency | 10% |

Success is measured now only by the percent viscosity preservation, but by the total influences upon post E and H brightness development and post extraction residual lignin. Results found below indicate that polyacrylic acid can preserve pulp cellulose viscosity and preserve brightness. Results are found in Table IV.

TABLE IV

| EXAMPLE | % $Cl_2$ | ADDITIVE | DOSAGE #/TON | POST EXTRACTION VISCOSITY | AVG. GE BRIGHTNESS |
|---|---|---|---|---|---|
| 18 | 3.91 | — | | 16.02 | 31.3 |
| 19 | 3.91 | C | 3 | 17.31 | 31.0 |
| 20 | 3.91 | F | 3 | 19.22 | 30.7 |
| 21 | 3.91 | C | 6 | 19.11 | 30.6 |
| 22 | 3.91 | F | 6 | 19.72 | 30.5 |
| 23 | 4.76 | — | | 12.86 | 32.3 |
| 24 | 4.76 | C | 3 | 17.71 | 32.4 |
| 25 | 4.76 | F | 3 | 17.18 | 32.4 |
| 26 | 4.76 | C | 6 | 19.10 | 32.6 |
| 27 | 4.76 | F | 6 | 18.43 | 32.5 |

Polymer F is a 30% solids polyacrylic acid before neutralization with ammonia gas and having a molecular weight of 2000 prepared according to U.S. Pat. No. 4,062,764.
Polymer C - See Table I.

We claim:

1. In a method for the chlorine bleaching of aqueous slurries of chemically produced cellulosic materials the improvement comprising maintaining in the aqueous slurry of chemically produced cellulosic materials during treatment with chlorine bleaching agent from 0.05–0.5% by weight of polyacrylic acid or its water-soluble alkali metal or ammonium salts based on the dry weight of cellulosic material in said aqueous slurry whereby a cellulosic material having improved brightness and fiber strength is obtained.

2. The method of claim 1 wherein the polyacrylic acid is present in its ammonium salt form.

3. The method of claim 1 wherein the polyacrylic acid is present in its sodium salt form.

4. The method of claim 1 wherein the polyacrylic acid is present as polyacrylic acid.

* * * * *